US007850393B2

(12) United States Patent
Hamel

(10) Patent No.: US 7,850,393 B2
(45) Date of Patent: Dec. 14, 2010

(54) DRY-CAST CONCRETE BLOCK

(75) Inventor: Denis Hamel, Baie d'Urfé (CA)

(73) Assignee: Transpavé Inc., St-Eustache, Québec (CA)

( * ) Notice: Subject to any disclaimer, the term of this patent is extended or adjusted under 35 U.S.C. 154(b) by 0 days.

(21) Appl. No.: 11/639,538

(22) Filed: Dec. 15, 2006

(65) Prior Publication Data

US 2008/0145148 A1 Jun. 19, 2008

(51) Int. Cl.
*E01C 5/06* (2006.01)

(52) U.S. Cl. ..... 404/36; 404/34; 404/41; 404/42

(58) Field of Classification Search ..... 404/41, 404/34–36, 39, 42; D25/113
See application file for complete search history.

(56) References Cited

U.S. PATENT DOCUMENTS

| | | | | | |
|---|---|---|---|---|---|
| 165,896 | A * | 7/1875 | Von Versen et al. | 501/154 |
| 2,605,681 | A * | 8/1952 | Trief | 404/41 |
| 3,602,111 | A * | 8/1971 | Laguardia Clemente | 404/41 |
| 3,891,340 | A * | 6/1975 | Bolli | 404/38 |
| 3,931,700 | A * | 1/1976 | Scanni et al. | 52/311.2 |
| 3,947,192 | A * | 3/1976 | Rosenberger | 404/41 |
| 4,262,467 | A * | 4/1981 | Faisant et al. | 52/311.2 |
| 4,973,192 | A * | 11/1990 | Hair | 404/34 |
| 5,244,303 | A * | 9/1993 | Hair | 404/41 |
| 5,449,245 | A * | 9/1995 | Glickman | 404/38 |
| D411,313 | S * | 6/1999 | Azar | D25/113 |
| 5,941,657 | A * | 8/1999 | Banze | 404/39 |
| D429,343 | S | 8/2000 | Milot | |
| 6,168,347 | B1 * | 1/2001 | Milot et al. | 404/34 |
| D439,677 | S * | 3/2001 | Mattox | D25/113 |
| 6,881,463 | B2 * | 4/2005 | Riccobene | 428/44 |
| D537,501 | S | 2/2007 | Riccobene | |
| D543,642 | S | 5/2007 | Castonguay et al. | |
| D553,759 | S * | 10/2007 | Hamel | D25/113 |
| 2007/0166102 | A1 * | 7/2007 | Cornaz | 404/34 |
| 2007/0258766 | A1 * | 11/2007 | Mugge | 404/34 |

FOREIGN PATENT DOCUMENTS

| | | |
|---|---|---|
| EP | 0724039 | * 10/1995 |

* cited by examiner

*Primary Examiner*—Raymond W Addie

(57) ABSTRACT

A dry-cast concrete block for use in a structure comprising a plurality of concrete blocks. The dry-cast concrete block comprises three convex sides and three concave sides alternating with the three convex sides. The dry-cast concrete block also comprises a surface located between the three convex sides and the three concave sides and comprising at least one portion having a cast texture with a natural stone appearance. Each of the three convex sides is adapted to register with either one of three concave sides of an adjacent one of the concrete blocks to enable positioning of the dry-cast concrete block in different positions relative to the adjacent one of the concrete blocks.

17 Claims, 6 Drawing Sheets

DRY-CAST CONCRETE BLOCK

FIELD OF THE INVENTION

The present invention relates to dry-cast concrete blocks with a natural stone appearance.

BACKGROUND

Concrete blocks intended to serve as paving units (e.g., pavers, paving tiles, etc.), wall construction units (e.g., masonry units, retaining wall units, etc.), ornamental blocks, steps, and other landscaping elements are sometimes provided with a natural stone appearance over an exposed portion thereof. Such concrete blocks can then be assembled into paved surfaces, walls or other structures that have a natural and aesthetic look.

Depending on their constituent concrete, concrete blocks can be broadly divided into dry-cast concrete blocks and wet-cast concrete blocks. Different processes are used to manufacture these two types of concrete blocks and, in particular, to provide them with a natural stone appearance.

Wet-cast concrete blocks may have a natural stone appearance realized directly during casting, but relatively long production times and requirements for numerous molds typically render impractical their efficient mass-production. For their part, dry-cast concrete blocks normally have relatively short production times and require only one or a few molds, which facilitates their mass-production. However, these relatively short production times impose constraints on a degree of surface irregularity that may be imparted to dry-cast concrete blocks during casting, thereby preventing realization of a natural stone appearance during casting. Dry-cast concrete blocks are thus typically subjected after casting to a mechanical artificial aging/weathering process (e.g., tumbling, splitting/breaking, object impacting, etc.) to realize desired natural stone characteristics, which decreases production efficiency.

Concrete blocks typically also have generally prismatic configurations, such as rectangular prism configurations. In some cases, these prismatic configurations may impose limitations in terms of appearance characteristics of structures made using such concrete blocks.

There is therefore a need for improvements in dry-cast concrete blocks having a natural stone appearance.

SUMMARY OF THE INVENTION

As embodied and broadly described herein, the invention provides a dry-cast concrete block for use in a structure comprising a plurality of concrete blocks. The dry-cast concrete block comprises three convex sides and three concave sides alternating with the three convex sides. The dry-cast concrete block also comprises a surface located between the three convex sides and the three concave sides and comprising at least one portion having a cast texture with a natural stone appearance. Each of the three convex sides is adapted to register with either one of three concave sides of an adjacent one of the concrete blocks to enable positioning of the dry-cast concrete block in different positions relative to the adjacent one of the concrete blocks.

The invention also provides a dry-cast concrete block for use in a structure comprising a plurality of concrete blocks. The dry-cast concrete block comprises three convex sides and three concave sides alternating with the three convex sides. The dry-cast concrete block also comprises a surface located between the three convex sides and the three concave sides.

The surface comprises at least two portions each having a cast texture with a natural stone appearance. The at least two portions are separated from each other by at least one depression of the surface. Each of the three convex sides is adapted to register with either one of three concave sides of an adjacent one of the concrete blocks to enable positioning of the dry-cast concrete block in different positions relative to the adjacent one of the concrete blocks.

These and other aspects of the invention will now become apparent to those of ordinary skill in the art upon review of the following description of embodiments of the invention in conjunction with the accompanying drawings.

BRIEF DESCRIPTION OF THE DRAWINGS

A detailed description of embodiments of the invention is provided below, by way of example only, with reference to the accompanying drawings, in which.

It is to be expressly understood that the description and drawings are only for the purpose of illustrating certain embodiments of the invention and are an aid for understanding. They are not intended to be a definition of the limits of the invention.

DETAILED DESCRIPTION OF EMBODIMENTS

Figure 1:
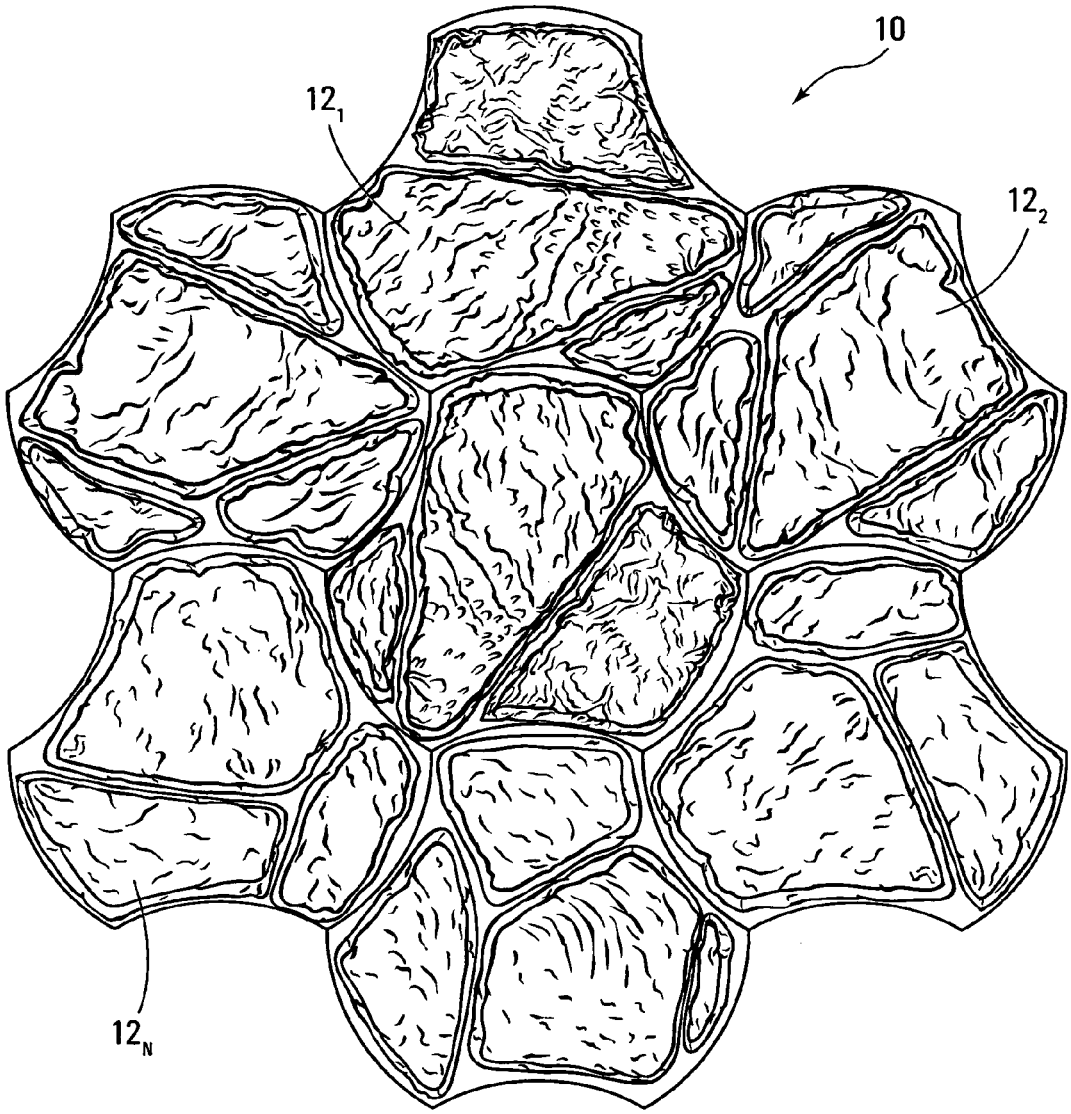
FIG. 1 shows a paved surface comprising a plurality of concrete blocks in accordance with an embodiment of the invention.

FIG. 1 shows a paved surface 10 comprising a plurality of concrete blocks $\mathbf{12}_1$-$\mathbf{12}_N$ in accordance with an embodiment of the invention. In this embodiment, the concrete blocks $\mathbf{12}_1$-$\mathbf{12}_N$ are pavers. In other embodiments, the concrete blocks $\mathbf{12}_1$-$\mathbf{12}_N$ may be paving tiles or any other type of paving units.

Figure 2:
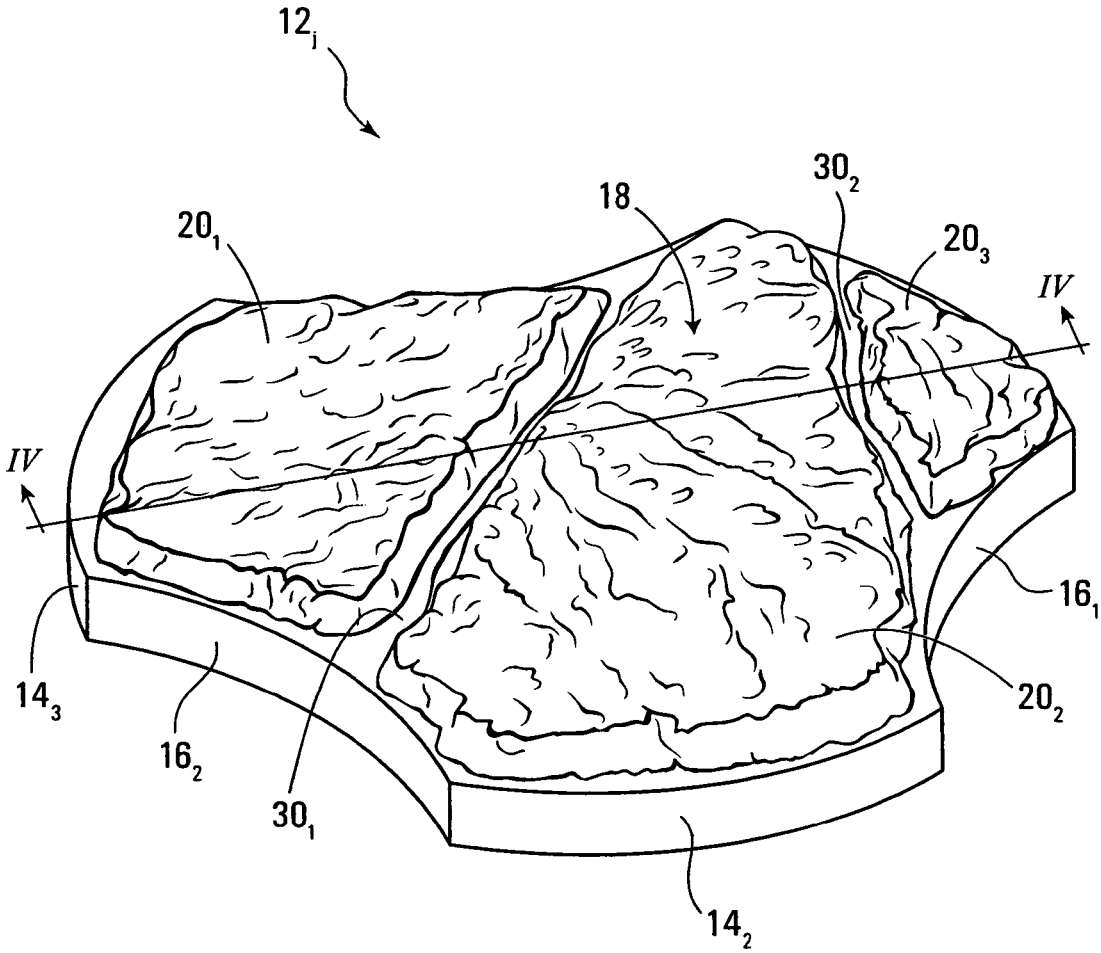
FIG. 2 shows a perspective view of a given one of the concrete blocks shown in FIG. 1.
Figure 3:
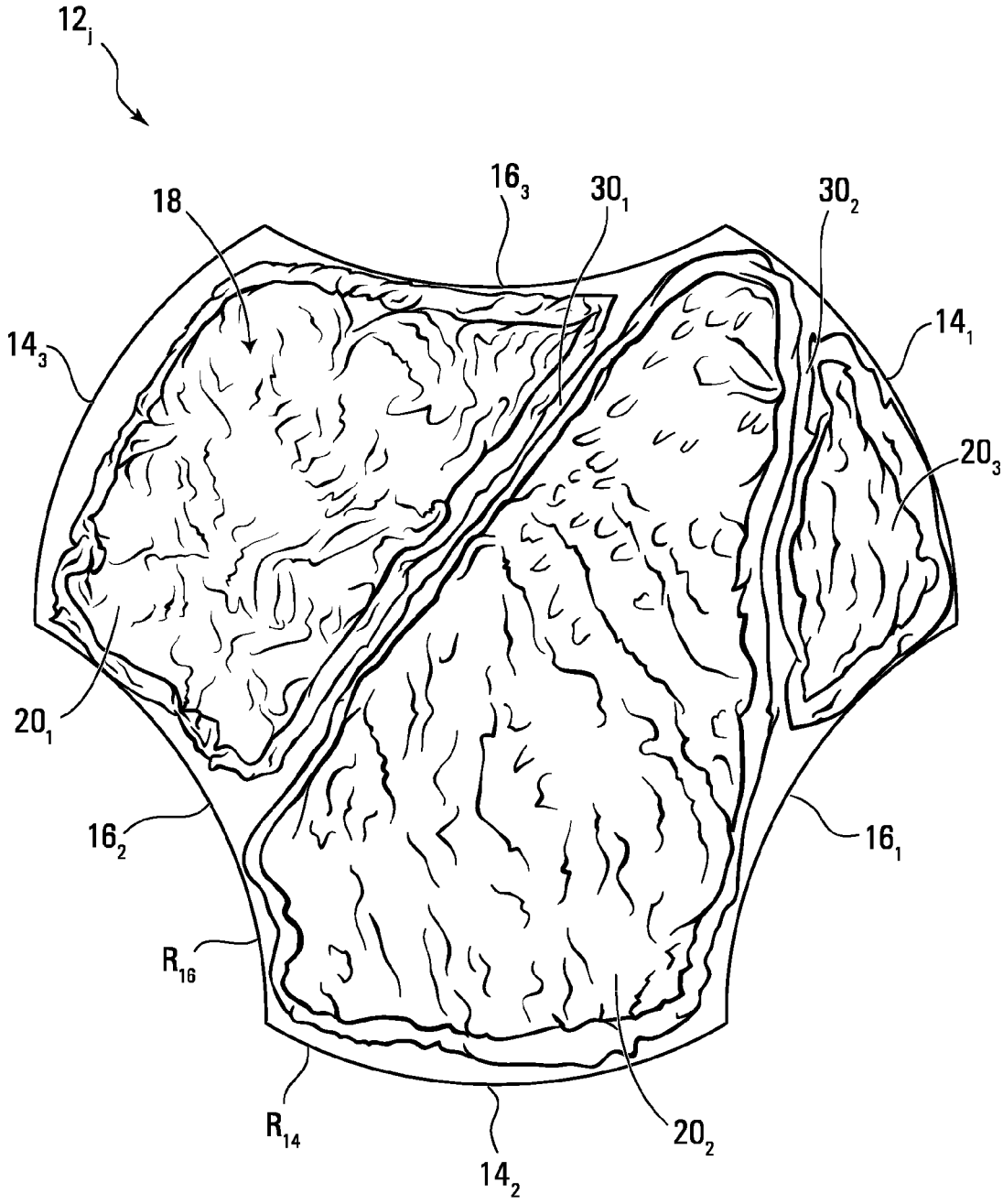
FIG. 3 shows a top view of the given one of the concrete blocks shown in FIG. 2.

With additional reference to FIGS. 2 and 3, a given concrete block $\mathbf{12}_j$ of the concrete blocks $\mathbf{12}_1$-$\mathbf{12}_N$ ($1 \leqq j \leqq N$) will be described in further detail. It will be appreciated that this description similarly applies to other ones of the concrete blocks $\mathbf{12}_1$-$\mathbf{12}_N$.

The concrete block $\mathbf{12}_j$ is a dry-cast concrete block, i.e., it is made of no-slump concrete. No-slump concrete (also known as zero-slump concrete) can be viewed as concrete with a slump of 6 mm or less. It will be appreciated that various types of no-slump concrete are possible and may be used.

The concrete block $\mathbf{12}_j$ comprises three convex sides $\mathbf{14}_1$-$\mathbf{14}_3$ and three concave sides $\mathbf{16}_1$-$\mathbf{16}_3$. The three concave sides $\mathbf{16}_1$-$\mathbf{16}_3$ alternate with the three convex sides $\mathbf{14}_1$-$\mathbf{14}_3$. As can be seen in FIG. 1, each of the convex sides $\mathbf{14}_1$-$\mathbf{14}_3$ of the concrete block $\mathbf{12}_j$ is adapted to register with either one of the three concave sides $\mathbf{16}_1$-$\mathbf{16}_3$ of an adjacent one of the concrete blocks $\mathbf{12}_1$-$\mathbf{12}_N$ in order to enable positioning of the concrete block $\mathbf{12}_j$ in different positions relative to the adjacent one of the concrete blocks $\mathbf{12}_1$-$\mathbf{12}_N$.

More particularly, each of the convex sides $\mathbf{14}_1$-$\mathbf{14}_3$ of the concrete block $\mathbf{12}_j$ has a radius of curvature $R_{14}$ and each of the concave sides $\mathbf{16}_1$-$\mathbf{16}_3$ of the concrete block $\mathbf{12}_j$ has a radius of curvature $R_{16}$. In this embodiment, the radius of curvature $R_{16}$ is slightly greater than the radius of curvature $R_{14}$ so as to facilitate registration of each of the convex sides $\mathbf{14}_1$-$\mathbf{14}_3$ of the concrete block $\mathbf{12}_j$ with either one of the three concave sides $\mathbf{16}_1$-$\mathbf{16}_3$ of an adjacent one of the concrete blocks $\mathbf{12}_1$-$\mathbf{12}_N$. For example, a ratio of the radius of curvature $R_{14}$ to the radius of curvature $R_{16}$ may be between 0.900 and 0.999 (e.g., the radius of curvature $R_{14}$ may be 264.5 mm and the radius of curvature $R_{16}$ may be 265 mm).

The concrete block $\mathbf{12}_j$ also comprises a surface 18 located between the convex sides $\mathbf{14}_1$-$\mathbf{14}_3$ and the concave sides $\mathbf{16}_1$-$\mathbf{16}_3$ and intended to be exposed when the concrete block $\mathbf{12}_j$ is placed in the paved surface 10. The surface 18 comprises three portions $\mathbf{20}_1$-$\mathbf{20}_3$ with a cast texture having a natural stone appearance, i.e., an aged, worn, or weathered appearance that resembles natural stone. As described later on, this cast texture is realized during casting of the concrete block $\mathbf{12}_j$ and may be based on a natural stone's surface which has been used to produce a mold for casting the concrete block $\mathbf{12}_j$. For ease of reference, the portions $\mathbf{20}_1$-$\mathbf{20}_3$ of the surface 18 and their cast texture with a natural stone appearance will hereinafter be referred to as the "natural stone-like surface portions" $\mathbf{20}_1$-$\mathbf{20}_3$.

In this embodiment, the natural stone-like surface portions $\mathbf{20}_1$-$\mathbf{20}_3$ are separated from each other by depressions $\mathbf{30}_1$ and $\mathbf{30}_2$ of the surface 18 that can serve as false joints. When the concrete block $\mathbf{12}_j$ is placed in the paved surface 10, the natural stone-like surface portions $\mathbf{20}_1$-$\mathbf{20}_3$ results in an area of the paved surface 10 perceivable as including several (in this case, three) natural stones of different sizes and configurations.

Figure 3A:
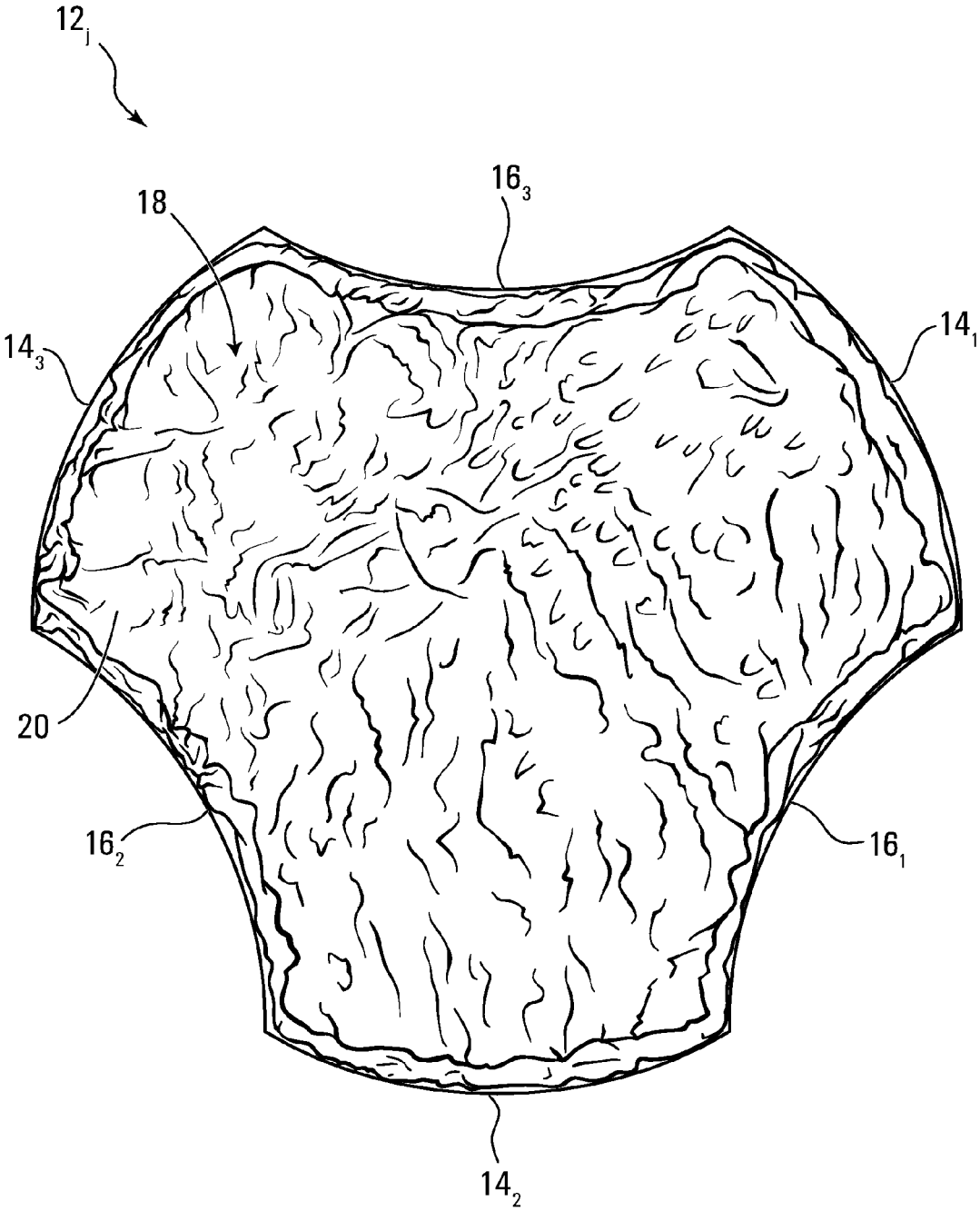
FIG. 3A shows a top view of a concrete block in accordance with another embodiment of the invention.

Although in this embodiment the surface 18 comprises a plurality of natural stone-like surface portions (in this case, the three natural stone-like surface portions $\mathbf{20}_1$-$\mathbf{20}_3$), it is to be understood that, in other embodiments, any number of natural stone-like surface portions may be provided. For example, in FIG. 1, some of the concrete blocks $\mathbf{12}_1$-$\mathbf{12}_N$ are provided with four natural stone-like surface portions. As another example, in a particular case, the surface 18 may comprise only one natural stone-like surface portion, which may be an entirety of the surface 18 (i.e., all of that surface) as shown in FIG. 3A or a limited portion of the surface 18 (i.e., not all of that surface).

Figure 4:
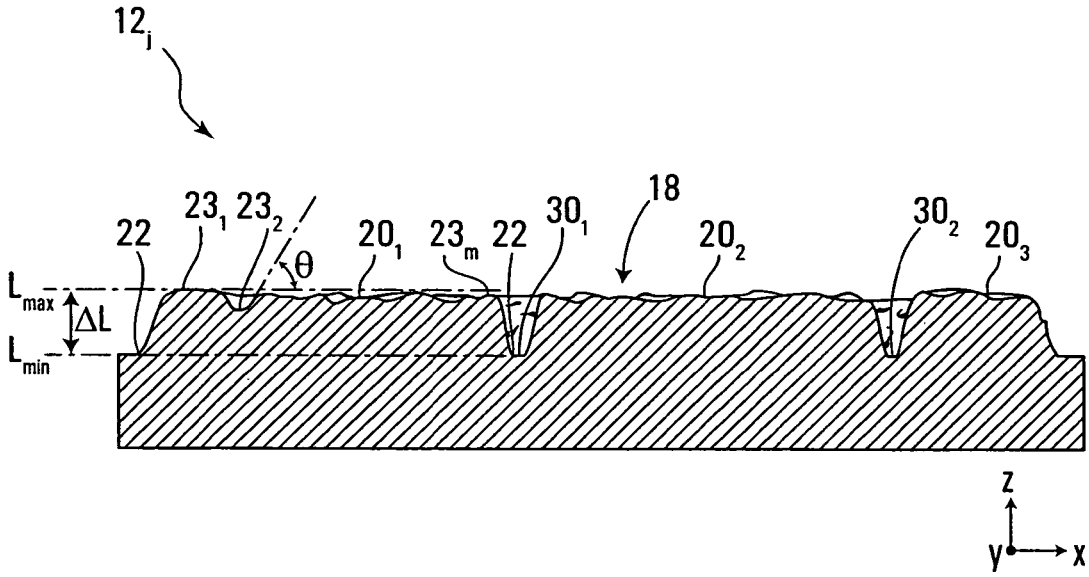
FIG. 4 shows a cross-sectional view of the given one of the concrete blocks shown in FIG. 2, taken along line 4-4.

With additional reference to FIG. 4, a given natural stone-like surface portion $\mathbf{20}_k$ of the natural stone-like surface portions $\mathbf{20}_1$-$\mathbf{20}_3$ ($1 \leqq k \leqq 3$) will be described in further detail. It will be appreciated that this description similarly applies to other ones of the natural stone-like surface portions $\mathbf{20}_1$-$\mathbf{20}_3$.

The natural stone-like surface portion $\mathbf{20}_k$ has a visually discernible boundary 22. In cases where the natural stone-like surface portion $\mathbf{20}_k$ would be contiguous to a chamfered, rounded, or otherwise non-natural stone looking edge portion of the concrete block $\mathbf{12}_j$ (e.g., an edge portion serving as a joint), the boundary 22 of that natural stone-like surface portion would be considered to be configured such that the chamfered, rounded or otherwise non-natural stone looking edge portion is not part of that natural stone-like surface portion.

The natural stone-like surface portion $\mathbf{20}_k$ includes a pattern of cast relief elements $\mathbf{23}_1$-$\mathbf{23}_M$ formed during casting of the concrete block $\mathbf{12}_j$. This pattern of cast relief elements $\mathbf{23}_1$-$\mathbf{23}_M$ includes a plurality of peaks and a plurality of valleys, which are sized so as to be visually distinguishable when the concrete block $\mathbf{12}_j$ is placed in the paved surface 10. It is to be understood that various other patterns of cast relief elements are possible.

The cast texture of the natural stone-like surface portion $\mathbf{20}_k$ defines a "surface level difference" $\Delta L$, which refers to the normal distance between a maximum level $L_{max}$ of that surface portion and a minimum level $L_{min}$ of that surface portion. As shown in FIG. 4, the concrete block $\mathbf{12}_j$ can be viewed as defining orthogonal X, Y and Z axes, where the X-Y plane is parallel to a plane that would be formed by the natural stone-like surface portion $\mathbf{20}_k$ if that surface portion was flat, i.e., the plane in which lies the boundary 22 of the natural stone-like surface portion $\mathbf{20}_k$. A level L at a given point of the natural stone-like surface portion $\mathbf{20}_k$ can be viewed as a plane parallel to the X-Y plane, and the surface level difference $\Delta L$ can be viewed as being measured along the Z axis.

In this example, the minimum level $L_{min}$ of the natural stone-like surface portion $\mathbf{20}_k$ is located at its boundary 22. Generally, the minimum level $L_{min}$ of a natural stone-like surface portion may be located anywhere on that surface portion, including not at its boundary. The maximum level $L_{max}$ of a natural stone-like surface portion may also be located anywhere on that surface portion, including at its boundary 22.

In this embodiment where the concrete block $\mathbf{12}_j$ is for use in a paving application, the surface level difference $\Delta L$ may greater than 10 mm, for example, between 10 mm and 30 mm. For instance, in one embodiment, the surface level difference $\Delta L$ may be about 20 mm. This enables the natural stone-like surface portion $\mathbf{20}_k$ to exhibit desired natural stone appearance characteristics, while maintaining a degree of surface irregularity suitable for supporting pedestrian or other traffic. It is generally contemplated that a surface level difference $\Delta L$ of greater than 4 mm achieves satisfactory results in terms of natural stone appearance of a surface portion of a concrete block since it enables presence of visually distinguishable cast texture features mimicking surface texture of natural stone.

It is to be noted that different ones of the natural stone-like surface portions $\mathbf{20}_1$-$\mathbf{20}_3$ of the concrete block $\mathbf{12}_j$ may define a common or distinct surface level difference $\Delta L$ and may have common or distinct maximum levels $L_{max}$ and minimum levels $L_{min}$.

Each of the cast relief elements $\mathbf{23}_1$-$\mathbf{23}_M$ of the natural stone-like surface portion $\mathbf{20}_k$ reaches a respective level L that is the maximum level $L_{max}$, the minimum level $L_{min}$, or a level therebetween. In this embodiment, a plurality of the cast relief elements $\mathbf{23}_1 \ldots \mathbf{23}_M$ are seen in FIG. 4 as extending to the maximum level $L_{max}$ of the natural stone-like surface portion $\mathbf{20}_k$ and separated from each other by other ones of the cast relief elements $\mathbf{23}_1 \ldots \mathbf{23}_M$ that only extend to lower levels Also, in this embodiment, each of the cast relief elements $\mathbf{23}_1 \ldots \mathbf{23}_M$ of the natural stone-like surface portion $\mathbf{20}_k$ that is a valley (e.g., the cast relief element $\mathbf{23}_2$) can be viewed as having a respective depth D, which refers to the normal distance between the maximum level $L_{max}$ of that surface portion and that valley's deepest point. Depending on the surface level difference $\Delta L$, in some embodiments, the respective depth D of each of one or more valleys of the natural stone-like surface portion $\mathbf{20}_k$ may be greater than 4 mm, for example, between 4 mm and 10 mm. This may further enhance natural stone appearance characteristics exhibited by the natural stone-like surface portion $\mathbf{20}_k$, while maintaining a degree of surface irregularity suitable for supporting pedestrian or other traffic.

The natural stone-like surface portion $\mathbf{20}_k$ is capable of interacting with ambient light to create shadows that further contribute to its natural stone appearance. More particularly, as shown in FIG. 4, each point of the cast texture of the natural stone-like surface portion $\mathbf{20}_k$ defines a respective "texture angle" θ, which refers to the angle between a plane parallel to the X-Y plane and a plane tangent to the natural stone-like surface portion $\mathbf{20}_k$ at that point. In one embodiment, the respective texture angle θ of each of a plurality of points of the natural stone-like surface portion $\mathbf{20}_k$ may be between about 75° and about 90°. This may contribute to creation of shadows on the natural stone-like surface portion $\mathbf{20}_k$ that further enhance its natural stone appearance. Configuring a dry-cast concrete block with a surface level difference ΔL in the above-mentioned ranges has been found to facilitate formation of such texture angles θ during casting. It is noted, however, that the above-mentioned values of texture angle θ are presented for example purposes only and are not to be considered limiting in any respect.

In this embodiment, the depression $\mathbf{30}_1$ of the surface 18 that separates the natural stone-like surface portions $\mathbf{20}_1$ and $\mathbf{20}_2$ can be viewed as having a respective depth, which refers to the normal distance between the maximum level $L_{max}$ of either of these surface portions and that depression's deepest point. Similarly, the depression $\mathbf{30}_2$ of the surface 18 that separates the natural stone-like surface portions $\mathbf{20}_2$ and $\mathbf{20}_3$ can be viewed as having a respective depth. Depending on the surface level difference ΔL, in some embodiments, the respective depth of each of the depressions $\mathbf{30}_1$ and $\mathbf{30}_2$ may be at least 10 mm, for example, between 10 mm and 30 mm. For example, in a particular case, the respective depth of each of the depressions $\mathbf{30}_1$ and $\mathbf{30}_2$ may be about 20 mm. This may further enhance natural stone appearance characteristics exhibited by the natural stone-like surface portion $\mathbf{20}_1$-$\mathbf{20}_3$ of the concrete block $\mathbf{12}_j$, while maintaining a degree of surface irregularity suitable for supporting pedestrian or other traffic. This may also enable fractionation of the concrete block $\mathbf{12}_j$ at specific locations (i.e., where the depressions $\mathbf{30}_1$ and $\mathbf{30}_2$ are located) during tamping of the concrete blocks $\mathbf{12}_1$-$\mathbf{12}_N$ (e.g., using a vibrating plate) after they have been placed in the paved surface 10.

It will thus be appreciated that when the concrete blocks $\mathbf{12}_1 \ldots \mathbf{12}_N$ are positioned in the paved surface 10, each concrete block's natural stone-like surface portions (such as the natural stone-like surface portions $\mathbf{20}_1$-$\mathbf{20}_3$ of the concrete block $\mathbf{12}_j$) contribute to providing a natural and aesthetic look to the paved surface 10 while maintaining surface irregularity to a degree suitable for supporting pedestrian or other traffic.

In addition, the three convex sides $\mathbf{14}_1$-$\mathbf{14}_3$ and the three concave sides $\mathbf{16}_1$-$\mathbf{16}_3$ of each of the concrete blocks $\mathbf{12}_1$-$\mathbf{12}_N$ enables each of the concrete blocks $\mathbf{12}_1$-$\mathbf{12}_N$ to be positioned in different positions relative to adjacent ones of the concrete blocks $\mathbf{12}_1$-$\mathbf{12}_N$. More particularly, when placing the concrete blocks $\mathbf{12}_1$-$\mathbf{12}_N$ in the paved surface 10, each of the concrete blocks $\mathbf{12}_1$-$\mathbf{12}_N$ can be oriented and positioned such that a selected one of its convex sides $\mathbf{14}_1$-$\mathbf{14}_3$ registers with one of the concave sides $\mathbf{16}_1$-$\mathbf{16}_3$ of an adjacent one of the concrete blocks $\mathbf{12}_1$-$\mathbf{12}_N$. This allows positioning of the concrete blocks $\mathbf{12}_1$-$\mathbf{12}_N$ in different positions relative to each other. In turn, this allows creation of different arrangements of natural stone-like surface portions, which can result in the paved surface 10 being perceivable as including several natural stones of various sizes and configurations that are arranged in various layouts.

Furthermore, the natural stone appearance of each of the concrete blocks $\mathbf{12}_1 \ldots \mathbf{12}_N$ is realized during casting of these concrete blocks, without requiring any subsequent mechanical artificial aging/weathering process (e.g., tumbling, splitting/breaking, object impacting, etc.). Moreover, since they are made of no-slump concrete, production time for the concrete blocks $\mathbf{12}_1 \ldots \mathbf{12}_N$ may be significantly less than that required for wet-cast concrete blocks. Concrete blocks such as the concrete blocks $\mathbf{12}_1 \ldots \mathbf{12}_N$ may therefore be mass-produced with high efficiency.

Although the above-described embodiments relate to concrete blocks for use in paving applications, this is not to be considered limiting in any respect as concrete blocks in accordance with other embodiments of the invention may be used in various other types of applications, including steps construction and other landscaping applications.

Figure 5:
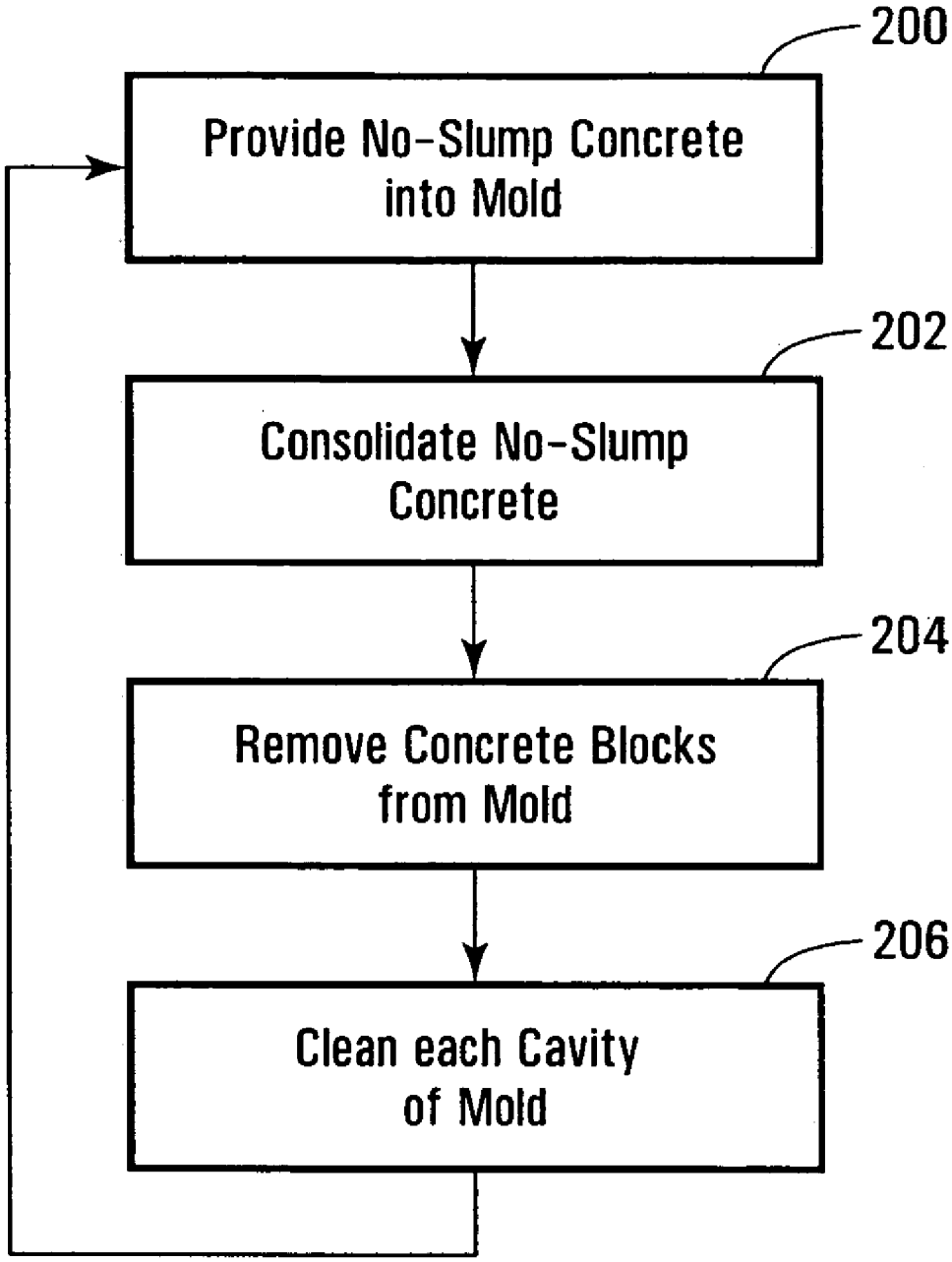
FIG. 5 is a flowchart illustrating an example of implementation of a process for manufacturing concrete blocks in accordance with an embodiment of the invention.

Turning now to FIG. 5, there is shown a flowchart illustrating an example of implementation of a process for manufacturing concrete blocks such as the above-described concrete blocks $\mathbf{12}_1 \ldots \mathbf{12}_N$.

At step 200, no-slump concrete is placed into a mold. To facilitate mass-production, in one embodiment, the mold has a plurality of cavities. In other embodiments, a plurality of molds each with a single cavity or each with a respective plurality of cavities may be used. To further facilitate mass-production, the mold may be located such that concrete blocks are placed on a production board when removed therefrom.

Each cavity of the mold is configured to form a respective concrete block comprising three convex sides and three concave sides alternating with the three convex sides, as well as a surface located between these convex and concave sides and comprising at least one natural stone-like surface portion (e.g., the concrete block $\mathbf{12}_j$ with its three convex sides $\mathbf{14}_1$-$\mathbf{14}_3$ and three concave sides $\mathbf{16}_1$-$\mathbf{16}_3$ and its surface 18 with three natural stone-like surface portions $\mathbf{20}_1$-$\mathbf{20}_3$). To that end, each cavity is defined in part by a surface of the mold that includes at least one portion with a surface texture corresponding to the desired natural stone appearance (hereinafter referred to as "the at least one natural stone-like surface portion of the mold"). In embodiments directed to producing concrete blocks with a plurality of natural stone-like surface portions (such as those shown in FIG. 1), each cavity of the mold that is intended to form such concrete blocks defines a corresponding plurality of natural stone-like surface portions. Each of the at least one natural stone-like surface portion of the mold thus defines a surface level difference ΔL' that corresponds to the desired surface level difference ΔL (FIG. 4) of the corresponding natural stone-like surface portion of the concrete block to be formed. Each point of this surface portion also defines a respective texture angle θ' corresponding to the desired texture angle θ (FIG. 4) of each point of the corresponding natural stone-like surface portion of the concrete block to be formed.

In order to closely simulate natural stone, in one embodiment, each given natural stone-like surface portion of the mold, and thus the corresponding natural stone-like surface portion of concrete blocks to be formed by the mold, is based on a natural stone's surface. In one example of implementation, data representative of at least a portion of the natural stone's surface is obtained, for instance, via three-dimensional scanning of the natural stone's surface. The obtained data may then be computer processed using software in order to generate data representative of the given natural stone-like surface portion of the mold. In some cases, this processing may include modifying the obtained data representative of at least a portion of the natural stone's surface to set the desired surface level difference ΔL' and texture angles θ' of the given natural stone-like surface portion. This processing may also ensure that the data representative of the at least one natural stone-like surface portion of the mold will result in the at least one corresponding natural stone-like surface portion of concrete blocks to be formed by the mold providing at least three points that are located relative to each other such that at least one other concrete block may be supported thereon in a stable manner.

As another possible consideration, in embodiments where individual ones of the cavities of the mold are intended to form concrete blocks of similar overall dimensions but with natural stone-like surface portions that have different configurations (e.g., different patterns of cast relief elements), these individual cavities may be designed to each have a common volume in order to facilitate production. In other words, a first cavity intended to form concrete blocks with natural stone-like surface portions having a first configuration may have a first volume, and a second cavity intended to form concrete blocks with natural stone-like surface portions having a second configuration different from the first configuration may have a second volume substantially corresponding to the first volume. This facilitates provision of substantially the same quantity of concrete into each cavity of the mold, which in turn facilitates efficient casting of concrete blocks in the mold and subsequent removal of the concrete blocks therefrom.

In embodiments where individual ones of the cavities of the mold are intended to form concrete blocks of significantly different overall dimensions and with natural stone-like surface portions that have different configurations (e.g., different patterns of cast relief elements), similar production benefits may be achieved by designing these individual cavities to each have a common volume per unit area.

The mold may be manufactured via computer-aided manufacturing based on the data representative of each given natural stone-like surface portion of the mold. With no-slump concrete being used, the mold may be made of metal or other rigid material. There is no requirement for one or more portions of the mold to be made of elastomeric material (e.g., rubber), which is typically used in molds for casting wet-cast concrete blocks with a natural stone appearance.

Thus, during step 200, each cavity of the mold is filled with no-slump concrete in order to form a concrete block comprising three convex sides and three concave sides alternating with the three convex sides, as well as a surface located between these convex and concave sides with at least one natural stone-like surface portion.

At step 202, the no-slump concrete in the mold is consolidated. Consolidation may include inducing vibration of the no-slump concrete in the mold so as to cause it to compact itself and closely conform to each cavity of the mold. A pre-vibration phase may be effected during step 200 to facilitate filling of the no-slump concrete in the mold and its eventual consolidation.

Consolidation may also include application of pressure on the concrete in combination with its vibration. It will be appreciated that consolidation may be effected using various other techniques.

Upon completion of step 202, the no-slump concrete in each cavity of the mold has formed into a concrete block comprising three convex sides and three concave sides alternating with the three convex sides, as well as a surface located between these convex and concave sides with at least one natural stone-like surface portion.

At step 204, the concrete block in each cavity of the mold is removed therefrom and continues on the production board. The concrete blocks may be directly stored for curing purposes. Since provision of a natural stone appearance is effected during casting, the concrete blocks do not require a subsequent mechanical artificial aging/weathering process (e.g., tumbling, splitting/breaking, object impacting, etc.) to impart them with such an appearance. Also, the concrete blocks may directly be stacked or palletized in a stable manner since the at least one natural stone-like surface portion of each concrete block may have been configured to provide at least three points that are located relative to each other to ensure such stable supporting. With the concrete blocks being made of no-slump concrete, curing times are relatively short such that they are available for use within a short period of time (e.g., one day).

At step 206, each cavity of the mold is cleaned such that casting of new concrete blocks may be effected. In one embodiment, a cleaning unit uses a fluid to clean each cavity of the mold. The fluid may be a gas (e.g., compressed air) or a liquid whose flow relative to each cavity of the mold, and particularly each natural stone-like area of the mold, removes therefrom substantially any remaining no-slump concrete. Such a fluid-based cleaning action advantageously enables rapid cleaning of each cavity of the mold, thereby increasing production efficiency. In some cases, the cleaning unit may also use, in addition to the fluid, one or more brushes to clean each cavity of the mold, whereby the fluid-based cleaning action is combined with a brushing cleaning action. It will be appreciated that other embodiments may employ various other types of cleaning action.

As shown in FIG. 5, in this example, the process returns to step 200 where a new production cycle begins. In some embodiments, utilization of no-slump concrete in combination with rapid cleaning of the mold and other elements of the process may enable a production cycle to take a relatively short period of time (e.g., 15 to 20 seconds in some cases).

Although various embodiments and examples have been presented, this was for the purpose of describing, but not limiting, the invention. Various modifications and enhancements will become apparent to those of ordinary skill in the art and are within the scope of the present invention, which is defined by the attached claims.

The invention claimed is:

1. A plurality of dry-cast concrete blocks for making a structure, each dry-cast concrete block comprising:

a top surface comprising a plurality of portions that are separated from one another by at least one depression of said top surface and that represent a plurality of natural stone blocks, each of said portions of said top surface having a cast texture with a natural stone appearance;

a bottom surface opposed to said top surface;

three convex sides;

three concave sides;

wherein said three concave sides alternate with said three convex sides such that a first one of said three convex sides extends between a first edge and a second edge of said dry-cast concrete block, a first one of said three concave sides extends between the second edge and a third edge of said dry-cast concrete block, a second one of said three convex sides extends between the third edge and a fourth edge of said dry-cast concrete block, a second one of said three concave sides extends between the fourth edge and a fifth edge of said dry-cast concrete block, a third one of said three convex sides extends between the fifth edge and a sixth edge of said dry-cast concrete block, and a third one of said three concave sides extends between the sixth edge and the first edge of said dry-cast concrete block;

wherein each convex side defines a convex surface extending from said top surface to said bottom surface and each concave side defines a concave surface extending from said top surface to said bottom surface; and wherein each of said three convex sides of any given one of said dry-cast concrete blocks is adapted to register with either one of said three concave sides of an adjacent one of said dry-cast concrete blocks to enable positioning of the given one of said dry-cast concrete blocks in different positions relative to the adjacent one of said dry-cast concrete blocks.

2. A plurality of dry-cast concrete blocks as claimed in claim 1, wherein each dry-cast concrete block is a paving unit.

3. A plurality of dry-cast concrete blocks as claimed in claim 1, wherein, for each dry-cast concrete block, each of said three convex sides has a first radius of curvature and each of said three concave sides has a second radius of curvature greater than the first radius of curvature.

4. A plurality of dry-cast concrete blocks as claimed in claim 3, wherein a ratio of the first radius of curvature to the second radius of curvature is between 0.900 and 0.999.

5. A plurality of dry-cast concrete blocks as claimed in claim 1, wherein said at least one depression serves as a false joint.

6. A plurality of dry-cast concrete blocks as claimed in claim 1, wherein said at least one depression has a depth of at least 10 mm.

7. A plurality of dry-cast concrete blocks as claimed in claim 1, wherein said at least one depression has a depth of between 10 mm and 30 mm.

8. A plurality of dry-cast concrete blocks as claimed in claim 1, wherein said at least one depression has a depth of about 20 mm.

9. A plurality of dry-cast concrete blocks as claimed in claim 1, wherein said plurality of portions comprises at least three portions each having a cast texture with a natural stone appearance.

10. A plurality of dry-cast concrete blocks as claimed in claim 1, wherein said cast texture of each of said plurality of portions has a surface level difference of greater than 4 mm.

11. A plurality of dry-cast concrete blocks as claimed in claim 1, wherein said cast texture of each of said plurality of portions has a surface level difference of between 10 mm and 30 mm.

12. A plurality of dry-cast concrete blocks as claimed in claim 1, wherein said cast texture of each of said plurality of portions has a surface level difference of about 20 mm.

13. A plurality of dry-cast concrete blocks as claimed in claim 1, wherein each of a plurality of points of said cast texture of each of said plurality of portions defines a texture angle between 75° and 90°.

14. A plurality of dry-cast concrete blocks as claimed in claim 1, wherein said cast texture of each of said plurality of portions comprises at least one valley having a depth of at least 4 mm.

15. A plurality of dry-cast concrete blocks as claimed in claim 1, wherein the natural stone blocks represented by said plurality of portions of the top surface of a first one of said dry-cast concrete blocks are arranged in a first configuration and the natural stone blocks represented by said plurality of portions of the top surface of a second one of said dry-cast concrete blocks are arranged in a second configuration different from the first configuration.

16. A plurality of dry-cast concrete blocks as claimed in claim 1, wherein the plurality of natural stone blocks represented by said plurality of portions of the top surface of a first one of said dry-cast concrete blocks is a first number of natural stone blocks and the plurality of natural stone blocks represented by said plurality of portions of the top surface of a second one of said dry-cast concrete blocks is a second number of natural stone blocks different from the first number of natural stone blocks.

17. A plurality of dry-cast concrete blocks as claimed in claim 1, wherein a given one of the natural stone blocks represented by said plurality of portions of the top surface of a first one of said dry-cast concrete blocks has a shape different from that of each of the natural stone blocks represented by said plurality of portions of the top surface of a second one of said dry-cast concrete blocks.

* * * * *